US005638634A

United States Patent [19]

Wadlington

[11] Patent Number: 5,638,634

[45] Date of Patent: Jun. 17, 1997

[54] APPARATUS AND METHOD FOR RECOVERY OF COTTON SEED FROM LINT

[75] Inventor: James B. Wadlington, Greenville, Miss.

[73] Assignee: Delta and Pine Land Company, Scott, Miss.

[21] Appl. No.: 309,487

[22] Filed: Sep. 22, 1994

[51] Int. Cl.[6] ..... A01G 1/00

[52] U.S. Cl. ..... 47/1.01; 47/58; 19/40

[58] Field of Search ..... 47/DIG. 9, 58.15, 47/1.01; 19/40, 41

[56] References Cited

U.S. PATENT DOCUMENTS 2,122,607 7/1938 Earle .
4,064,636 12/1977 Downing .
4,343,070 8/1982 Wade et al. .

FOREIGN PATENT DOCUMENTS 2041719 9/1980 United Kingdom .

OTHER PUBLICATIONS

Derwent Pub. Ltd., London, GB, AN 87-241537 & SU,A,1 283 260 ((COTQ) Ind Res Inst), Abstract, Jan. 15, 1987.

Derwent Pub. Ltd., London, GB, AN 86-117836 & SU,A,1 183 572 ((AZAG=) Azerb Agric Inst), Abstract, Oct. 7, 1985.

*Primary Examiner*—Terry Lee Melius
*Assistant Examiner*—Joanne C. Downs
*Attorney, Agent, or Firm*—Rothwell, Figg, Ernst & Kurz

[57] ABSTRACT

A method and apparatus for recovering cottonseed from the lint in batch quantities for planting purposes. The system utilizes a dilute acid approach and provides for gradual mixing of the fuzzy seed and a dilute acid solution followed by batch drying and hydrolysis in a rotating drum reaction chamber in which heated air at a controlled temperature is circulated. The process conditions and the flight pattern of the fuzzy seed within the rotating drum are controlled to avoid trauma to the seed and thereby assure suitability of the recovered seed for planting purposes.

10 Claims, 4 Drawing Sheets

APPARATUS AND METHOD FOR RECOVERY OF COTTON SEED FROM LINT

The present invention relates to apparatus and methods for the recovery of cotton seed from the lint for planting purposes and, in particular, to apparatus and methods for the recovery of batch quantities of seed in a reliable manner and without damage to the seed with respect to its suitability for planting purposes.

BACKGROUND

It is a common practice in the art to recover cotton seeds from the lint which remains after the cotton product itself is separated from the crop. The seeds so recovered are used for the production of cotton seed oil and, in some cases, for planting purposes. In cases where the seed is recovered for planting purposes, care must be taken not to damage the seeds such that germination would be impaired. In the recovery of cotton seed from the lint, there are several different methods which are commonly used.

The older and less frequently used method is known as mechanical delinting. This method involves separating the seed from the lint by using saw delinting and/or brush delinting. In the saw delinting method, the lint is cut from the seeds by means of saws, after which the seeds may be dropped through a flame to remove the residual portion of the lint remaining after the saw delinting step.

Another type of mechanical delinting is known as brush delinting. In this method, a series of brushes are rotated against the inner surface of a perforated drum in which the fuzzy seeds are loaded, whereby the lint is removed from the seeds mainly by friction.

A mechanical delinting process which is particularly suitable for recovery of seed from lint for planting purposes is disclosed in U.S. Pat. No. 5,249,335—Jones, which is assigned to the same assignee as the present application.

Another approach to the recovery of seed for planting purposes involves utilizing chemical methods which include the use of hydrogen chloride gas and sulfuric acid. There are several different approaches which have been employed in the use of these chemicals to delint fuzzy cotton seed.

One of these is known as the concentrated sulfuric acid method. In this method, concentrated sulfuric acid is applied to the fuzzy cotton seed. Almost instantly, the acid reacts with the lint and the lint is removed and hydrolyzed into its components. The seed is then rinsed with water to remove the acid and is dried and further processed with seed processing equipment well known in the art.

There are two major disadvantages with the concentrated sulfuric acid method. One is that the rinse water represents an environmental problem and the other is that the process also removes the oil in the seed coat which shortens the shelf life or the time period in which the seed remains viable.

Another chemical method is known as the anhydrous hydrogen chloride gas method. This method involves injecting HC1 gas into a closed reaction chamber which contains a charge of fuzzy seed. The HC1 gas reacts with the lint on the seed and the seed is then emptied from the reaction chamber into a buffer. In the buffer, the lint is buffed from the seed by means of rotating screens.

A disadvantage of the anhydrous hydrogen chloride gas method is that any of the seeds which have been cracked or otherwise physically damaged or which have openings of any kind in the shell of the seed will be killed by the entry of the gas into the interior of the seed. Also, the gas is hygroscopic and the system can therefore be used only in an arid or semi-arid environment where the relative humidity is consistently low.

Another chemical method is known as the dilute sulfuric acid method which was developed to avoid many of the disadvantages of the above discussed chemical methods. In this method, a dilute sulfuric acid solution of approximately 10% by weight of sulfuric acid and approximately 0.05% of surfactant (used as a wetting agent) in water is used to dampen the lint on the fuzzy seed. The dampened fuzzy seed is then dried in rotary driers, which are typically about six feet in diameter and about thirty feet long.

As the temperature of the dampened fuzzy seed is increased in the driers, the water in the solution, which has a lower boiling point than the acid, will begin to evaporate from the seed thereby causing the acid which remains on the seed to become more concentrated. As the acid concentration on the fuzzy seed approaches 100%, the lint is abruptly hydrolyzed by the acid and breaks off from the seed in the form of a dry powder. The powder is removed by the heated air stream used in the drying process.

The dilute sulfuric acid methods in use at the present time differ from each other primarily in the methods which are used to apply the dilute acid solution to the fuzzy seed. In the centrifuge method, the cotton seed is first flooded with dilute acid and then partially dried by centrifuging to produce basically a 10% wet pick-up on the seed. In the foam acid system, a foam generator converts the dilute acid solution to foam which is then applied to the seed. Other methods involve the direct application of the dilute acid solution to the seed.

In the dilute acid process as practiced in the prior art, the dilute acid solution is typically added in large amounts to large bulk quantities of fuzzy seed. This is done by flooding, spraying or the like of the dilute acid solution on large bulk quantities of seed as described above and requires relatively severe agitation of the seed to provide for the distribution of the acid solution throughout the seed bulk with resulting trauma to the seed. In addition, such prior art methods of applying the dilute acid solution to the fuzzy seed typically result in the application of excess acid to the seed. When subjected to the drying and hydrolyzation reaction, this excess acid can further damage the seed.

Present dilute acid systems are large, continuous process systems which are configured for continuous product throughput. Such systems have been found to be advantageous in the recovery of seed for planting in large volume commercial applications where relatively harsh conditions are acceptable and where the seed are graded after recovery depending upon the quality thereof. However, such prior art systems are not suitable for use in the recovery of "breeder seed" in relatively small quantities where, in particular, the seeds are from new varieties and therefore very valuable in the process of increasing from just a few seeds to large scale commercial quantities. In these cases, the new seed varieties which have desirable fiber characteristics may also be more easily damaged because the seed coats may be thinner or otherwise subject to damage or because the new seeds may be more vulnerable to impact, heat or other parameters typically encountered in the recovery process.

Such valuable breeder seeds can thus be subject to damage and even the loss thereof when subjected to the recovery conditions typically present in the large commercial delinters of the prior art as described above. For example, such seed may be easily damaged when subjected to vigorous agitation such as used in large commercial delinters such as those described above. The same applies to the high temperatures typically present in the driers used in the dilute acid method.

In such prior art commercial delinters, the dilute acid saturated fuzzy seed are tumbled within a large continuously rotating drum in which heated air is circulated. The saturated fuzzy seed are continuously introduced into the drum at one end thereof and continuously removed at the other end thereof. Drying and hydrolysis and carried out as a continuous process as the seed are agitated and moved axially within the drum from the input end to the exit end where the delinted seed are removed.

The whole process is thus continuous. That is, the dilute acid saturated fuzzy seed are loaded into the drum at one end and are moved axially within the drum while being agitated or tumbled to carry out drying and hydrolysis. The length of the drum and the other parameters related to the delinting process are selected such that the process is completed as the seed reach the exit end of the rotating drum. Thus, the seed are moved axially as well as radially within the drum.

In addition, the configuration and rotational velocity of the drum is such that the seed are pitched or lofted during rotation of the drum to cause them to impact the internal metal surfaces of the drum, thereby causing trauma to the seed. This trauma causes damage to the seed and reduces its suitability for planting purposes.

Accordingly, there has existed a need for a cotton seed delinting system that can be fabricated with a low capital investment and which meets the following criteria:

(a) The ability to delint seed with thin walled seed coats. Such seed is easily damaged when vigorously agitated as is the case with large commercial delinters. In such large commercial delinters, the seed coats tend to crack and fall off the seed, thereby preventing the ability to maintain high quality seed standards.

(b) The ability to delint seed at low temperatures in order to prevent heat damage to the seed. This is of particular importance when dealing with small increase lots developed at the research stage where supplies of the seed are limited.

(c) The ability to delint seed in small quantities which are in an increase program (a program to increase supply) or which are otherwise in limited supply. It has been found to be almost impossible to delint small amounts of cotton seed in continuous flow systems.

(d) The ability to be easily moved from one location to another to permit delinting on site on small land areas which would not accommodate the construction of a large scale fixed installation.

All of the foregoing criteria should be present without significant adverse impact on the environment.

It is a primary object of the present invention to provide a batch delinting system which meets at least the foregoing criteria.

SUMMARY OF THE INVENTION

The present invention provides, in one embodiment thereof, a batch delinting apparatus and method utilizing a dilute acid approach in which unique controls of the process steps are applied and regulated in such a manner as to assure that the seed, including even special varieties in the form of breeder seed, are reliably recovered at a high yield without mechanical or chemical damage to the seed. In one embodiment of the invention, a batch delinting apparatus is provided comprising a supply source of dilute sulfuric acid such as a container means of a selected size for containing a controlled volume of dilute sulfuric acid and surfactant solution and which is instrumented and controlled such that the dilution level of the dilute solution is controlled within the desired range. The supply source of dilute acid solution may also be a mixing apparatus in which supplies of concentrated acid and water and surfactant are continuously mixed through a nozzle at the point of application to the fuzzy seed. Combined with the container means of precisely controlled dilute sulfuric acid solution is a feeding and mixing apparatus which is preferably in the form of an elongated trough having a screw type feeder mounted for rotation in and extending through the lower portion thereof to gently move and combine a feed stream of fuzzy cotton seed with a feed stream of dilute sulfuric acid solution along the trough from one end to the other thereof.

The fuzzy seed and the dilute sulfuric acid solution are fed into the trough at one end thereof and moved through the trough by the screw type feeder while the seed and the dilute acid solution are gently mingled and mixed together to wet the lint with the dilute sulfuric acid solution. This gradual mixing of the two feed streams, one of the dilute acid solution and the other of the fuzzy seed, provides for thorough saturation of the fuzzy seed with the dilute acid solution in a gentle mixing action without applying excess acid to the seed. At the opposite end of the trough from the input end thereof, the lint on the fuzzy seed has thoroughly absorbed and has become substantially saturated with the dilute acid solution and the saturated fuzzy seed is removed from the trough. The surfactant in the dilute acid solution acts as a wetting agent and enhances the absorption process.

The fuzzy seed, which is saturated with dilute acid solution, is removed from the trough and fed into a batch size drying chamber which is preferably in the form of a cylindrically shaped drum. The drum is rotated to tumble the seed while a stream of heated air is directed through the drum to dry the seed and cause a hydrolysis reaction. Seed temperature is controlled by controlling exit air temperature such that the seed temperature does not exceed a level at which heat damage can occur.

The design and flight placement (the direction of the flight pattern of the seed within the chamber) of the drying chamber are selected such that the process is extremely gentle. Features of the present invention which provide such advantages are, among others, close flight placement of the seed in flight within the drying chamber, which minimizes seed agitation, design of the internal configuration of the reaction drum such that the seed cushion each other during rotation of the drum and do not to any significant degree impact the metal structure, and a low rotational speed of the drum to remove the hydrolyzed lint from the seed.

Other objects and advantages of the present invention will be explained in further detail below in connection with the appended drawings.

DETAILED DESCRIPTION OF THE INVENTION

Figure 1:
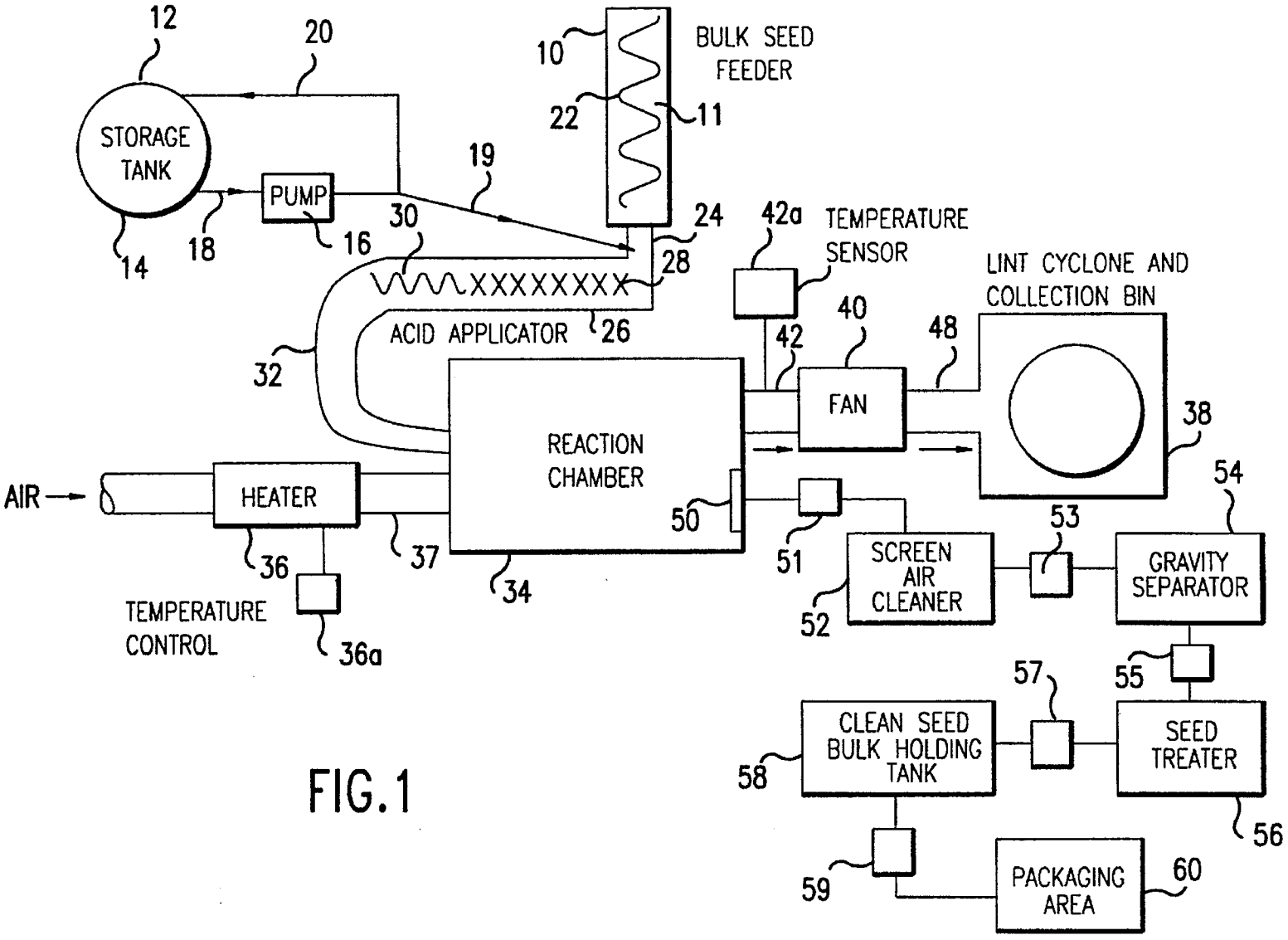
FIG. 1 is a block diagram of a batch cotton seed delinting system embodying the present invention.

Referring now to the embodiment of FIG. 1, which shows a block diagram of a batch type cotton seed delinter embodying the present invention, fuzzy cotton seed 11 which is to be delinted is stored in a bulk seed feeder 10. A solution 12 of sulfuric acid, surfactant and water is stored in batch tank 14. The batch tank 14 should have a storage capacity selected to accommodate precise control of the mix of the stored solution and, in a typical case, may be, for example, of a capacity of about one thousand gallons.

The solution 12 typically contains about 10% by weight sulfuric acid, 0.05% by weight surfactant, and the remainder water. It is to be understood that the solution 12 may vary from this composition over a range of constituent components although the amount of acid present should remain in the dilute range, preferably in the range of about 10% or less. The solution 12 is removed from the storage tank 14 by means of a pump 16, which pumps the solution from the tank 14 through line 18 to a discharge line 19. A portion of the solution is recirculated back to the tank 14 through a line 20 which forms a recirculation loop. Recirculation of the solution 12 within the tank 14 assures that homogeneity of the solution is maintained.

The fuzzy seed 11 is removed from the bulk seed feeder 10 by means of a suitable conveyer 22 and deposited at an input 24 of an acid applicator 26. In one construction of a batch delinter embodying the present invention as shown in FIG. 1, the acid applicator 26 was formed of a U-shaped trough, about twelve inches wide and about ten feet long having therein about an eight foot length of mixing paddles 28 followed by about two feet of well known auger flighting 30. Positioned at the exit end of the acid applicator 26 is an exit chute 32 for conveying the saturated fuzzy seed from the acid applicator to a reaction chamber 34.

The solution 12 is pumped from the tank 14 through the discharge line 19 to the acid applicator 26 and is introduced to the acid applicator at the input 24 thereof along with the fuzzy seed from the bulk seed feeder 10. Both the fuzzy seed 11 and the dilute acid solution 12 are introduced together as separate feed streams into the acid applicator 26 at the inlet 24 thereof. The acid solution 12 is gradually absorbed by the seed 11 as the two are mixed together and moved through the acid applicator 26 by the mixing paddles 28 and the auger flighting 30.

The separate feed streams of the fuzzy seed 11 and a feed stream of the dilute sulfuric acid solution 12 are fed together into the trough at one end thereof and moved through the trough as described above while the seed and the dilute acid solution are gently mingled and mixed together to wet the lint on the seed with the dilute sulfuric acid solution. The volume flow rates of the dilute acid and fuzzy seed feed streams are selected to provide just enough acid to fully saturate the lint on the seed after thorough mixing along the extended path in the elongated trough of the acid applicator 26. This gradual mixing of the two feed streams, one of the dilute acid solution 12 and the other of the fuzzy seed 11, over the extended flow path through the acid applicator 26 provides for thorough saturation of the fuzzy seed with the dilute acid solution in a gentle mixing action without applying excess acid to the seed.

The concentration of acid in the acid solution 12 is preferably maintained with an upper limit in the range of about 10% or so such that the fuzzy seed 11 is not subjected to a strong acid solution. This is also important for extending and maintaining the length of time over which the delinted seed will remain viable after delinting. The amount of acid solution used in relation to the seed weight is also an important factor to be controlled. In one construction of a batch type delinter embodying the present invention, it was found that the application of about fifty gallons of acid solution per ton of fuzzy seed provided excellent results.

Following application of the acid solution to the fuzzy seed, the seed is fed through the chute 32 into the reaction chamber 34. The process is controlled such that the seed remains in the reaction chamber 34 for a time interval as required for drying and lint hydrolyzation. In one embodiment of the present invention, it was found that a dwell time of the seed in the reaction chamber 34 in the range of about thirty minutes was adequate for this purpose. The exact time in each case will depend upon the amount of saturated fuzzy seed present, the dimensions of the reaction chamber and the particular process parameters which are chosen based on the principles of the invention as set forth herein.

Heated air, which is heated in a heater 36, is introduced into the reaction chamber 34 through an air inlet 37 and circulated though the reaction chamber and into a lint cyclone and collection bin 38 by means of a fan 40. The temperature of the heated air is regulated by a temperature control **36*a*. Air is removed from the reaction chamber 34 at the opposite end thereof through a duct 42 and delivered to fan 40 from whence it is delivered through a duct 48 to the lint cyclone and collection bin 38. Positioned within the exit duct 42 is a temperature measuring device 42*a* which measures the temperature of the heated air as it is discharged from the drum and provides a feedback signal for the temperature control 36*a* for controlling the temperature of the heated air exiting the drum. That is, the exit air temperature feedback signal from the exit air temperature sensor 42*a* is connected to the air temperature control 36*a* of the heater 36** to regulate and limit the maximum temperature of the air at the point of exit of the heated air from the drum.

Conditions in the reaction chamber 34, namely the temperature of the heated air in the reaction chamber, the level of seed agitation and the length of time in which the seed remains in the reactor are controlled such that no substantial chemical or mechanical damage is done to the seed in the drying and hydrolysis process. For example, in one construction of a batch type delinter embodying the present invention, the temperature of the exit air at the exit duct 42 from the reaction chamber 34 was maintained at or below about 130° F. to 140° F. while an air volume flow of about 5,000 cubic feet per minute was maintained for seed charges in the range of up to about 4,000 pounds. These conditions assured that the seed temperature never exceeded the exit air temperature of about 130° F. to 140° F. During the drying and hydrolyzation process, the rotational speed of the drum was maintained at a substantially constant speed selected within the range of about 18 to 22 revolutions per minute and preferably less than about 30 revolutions per minute. In addition, the flight pattern of the seed within the drum is further controlled by the internal configuration of the drum such that, during the rotation of the drum, the seed fall back on themselves within the drum and are thus cushioned against direct impact with the interior metal walls of the drum. The manner in which this is accomplished will be set forth in detail below. It was found that the speed of the drum should be maintained substantially constant and that, for the embodiment presented herein, a substantially constant rotational speed of less than about 30 revolutions per minute and preferably within the range of about 18 to 22 revolutions per minute produced good results. It was found that these conditions provided gentle delinting of the fuzzy seed and allowed recovery of batches of virtually undamaged delinted seed suitable for replanting.

The lint on the fuzzy seed is dried and hydrolyzed in the reaction chamber 34 and the hydrolyzed lint is carried off through the discharge duct 42 through the fan 40 to the lint cyclone and collection bin 38. After the lint has been dried and hydrolyzed in the reaction chamber 34 and carried off to the lint cyclone and collection bin 38, the delinted seed is removed from the reaction chamber through a discharge gate 50.

The delinted seed is then processed though a screen air cleaner 52, a gravity separator 54 and a seed treater 56 to a clean seed bulk holding tank 58. The delinted seed, which is now suitable for planting, may then be delivered to a packaging area 60 for packaging for further use.

Flow control devices 51, 53, 55, 57 and 59 may be employed to control the flow at each of the steps just described.

Figure 2:
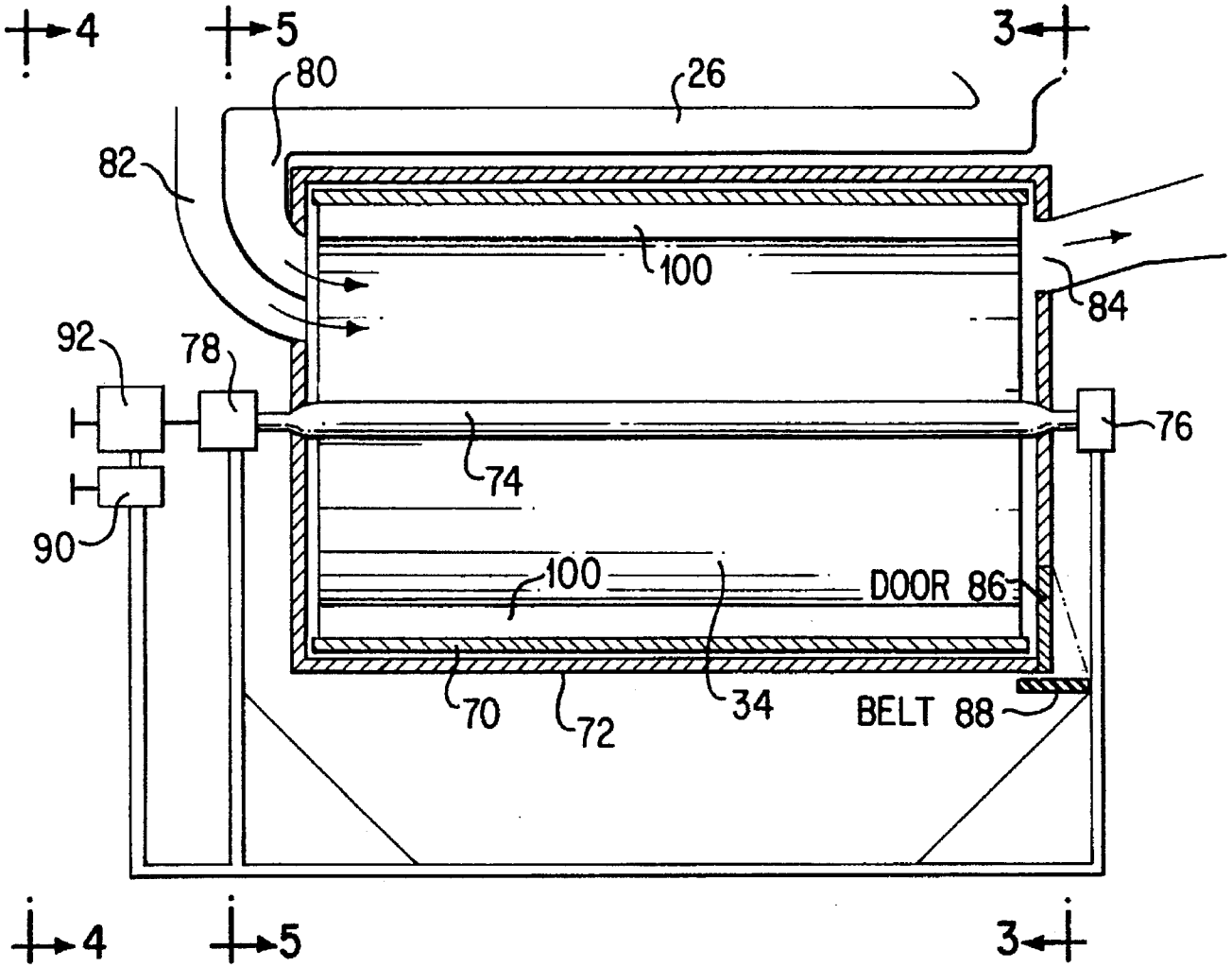
FIG. 2 is a schematic side view of the reaction chamber of the embodiment of FIG. 1.

In a particular embodiment of the delinting system illustrated in block diagram form in FIG. 1, the reaction chamber 34 is shown in further detail in FIGS. 2, 3, 4, 5 and 6. With reference to FIG. 2, the reaction chamber 34 comprises an outer housing 72 in which is mounted an open ended cylindrical drum 70. The drum 70 is mounted on a shaft 74 which is supported for rotation at the opposite ends thereof in bearings 76 and 78. The drum 70 is supported on the shaft 74 by means of radial spokes which are not shown in the cross sectional view of FIG. 2. In this embodiment, the acid applicator 26 is mounted above the housing 72 with a discharge chute 80 positioned at the exit end of the acid applicator and connected to the interior of the housing 72 and the drum 70 to feed the acid solution dampened fuzzy seed into the reactor chamber 34. Positioned within the drum 70 are a plurality of radially inwardly extending guide vanes 100, the function of which will be explained below in connection with the description of FIG. 6.

Figure 4:
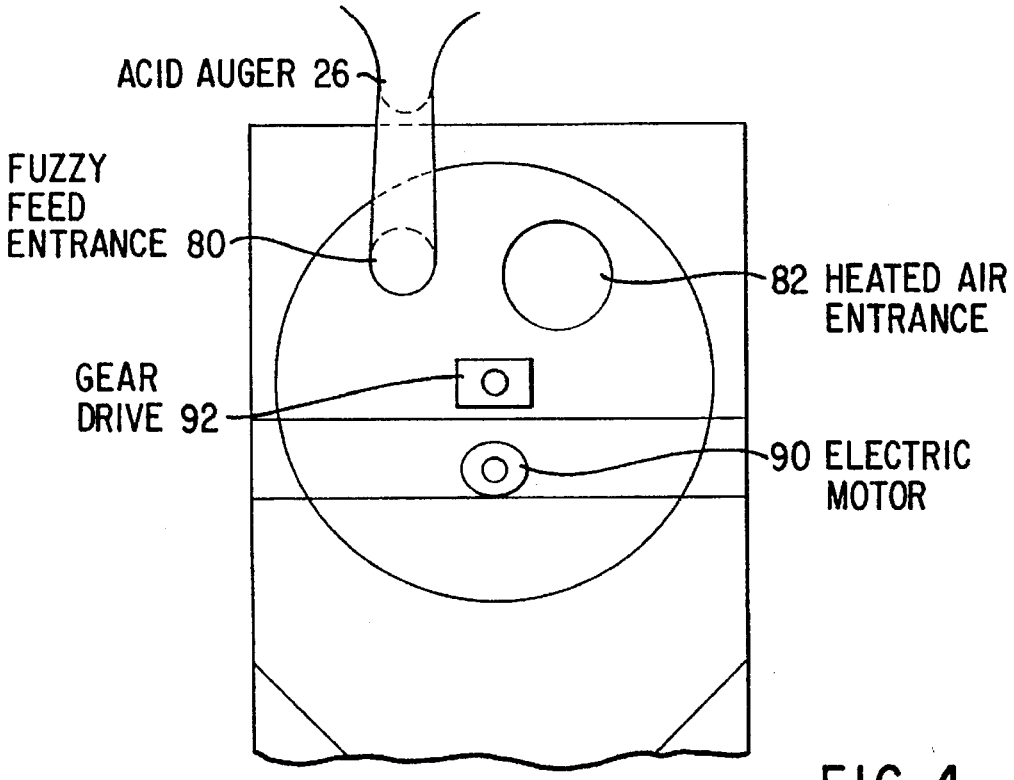
FIG. 4 is an end view of the entrance end of the reaction chamber of FIG. 2 taken along the plane A—A of FIG. 2.
Figure 5:
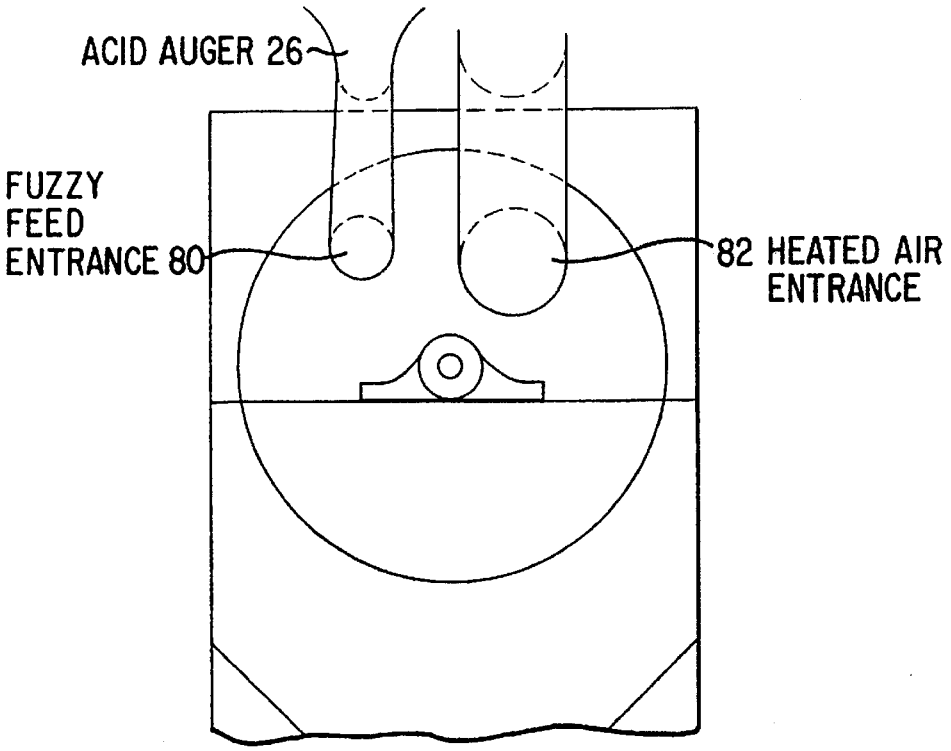
FIG. 5 is another end view of the entrance end of the reaction chamber of FIG. 2 taken along the plane B—B.

As best seen in FIG. 4, a heated air entrance 82 is positioned adjacent the seed entrance chute 80. At the opposite end of the housing 72 from the chute 80 and the heated air entrance 82, there is positioned a heated air exit 84. Below the heated air exit there is positioned an exit door 86 which is hinge mounted in the housing 70 to permit the removal of the delinted seed from the reactor. Directly below the exit door 86, there is positioned a conveyor belt 88 which conveys away the delinted seed discharged from the exit door 86. The axis of rotation of the drum 70 is inclined slightly with respect to the horizontal, preferably less than about 10°, so that the interior surface thereof slopes gently toward the exit end of the drum where the exit door 86 is located. This allows the gradual movement of the seed in the direction of the exit door and facilitates the removal of the delinted seed at the exit door 86.

The drum 70 is continuously rotated during the delinting process by an electric motor 90 connected through a gear box 92 to drive the shaft 74 of the drum 70. The rotational speed of the drum 70 is sensed by a suitable speed sensor (not shown) and the speed is regulated at the desired substantially constant rotational speed by feedback control from the drum speed sensor to the electric motor 90 employing any suitable motor speed control system well known to those skilled in the art. As stated above, the rotational speed of the drum 70 is regulated at a substantially constant speed which, for the particular embodiment presented herein, was selected to be in the range of less than about 30 revolutions per minute and preferably about 18 to 22 revolutions per minute.

The size of the batch quantity which is selected for processing in the drum 70 is such that, in relation to the size of the drum and the parameters of heated air flow, the seed is not crushed or severely impacted in the process of evaporating the water from the dilute acid solution to concentrate the acid and hydrolyze the lint on the fuzzy seed. It has been found that excellent recovery was effected of delinted seed suitable for planting with a drum size of about six feet in diameter and ten feet long, a dilute acid saturated seed charge of up to 4,000 pounds with a heated air volume flow rate of about cubic feet per minute and an exit air temperature of about 130° F. to 140° F.

Figure 3:
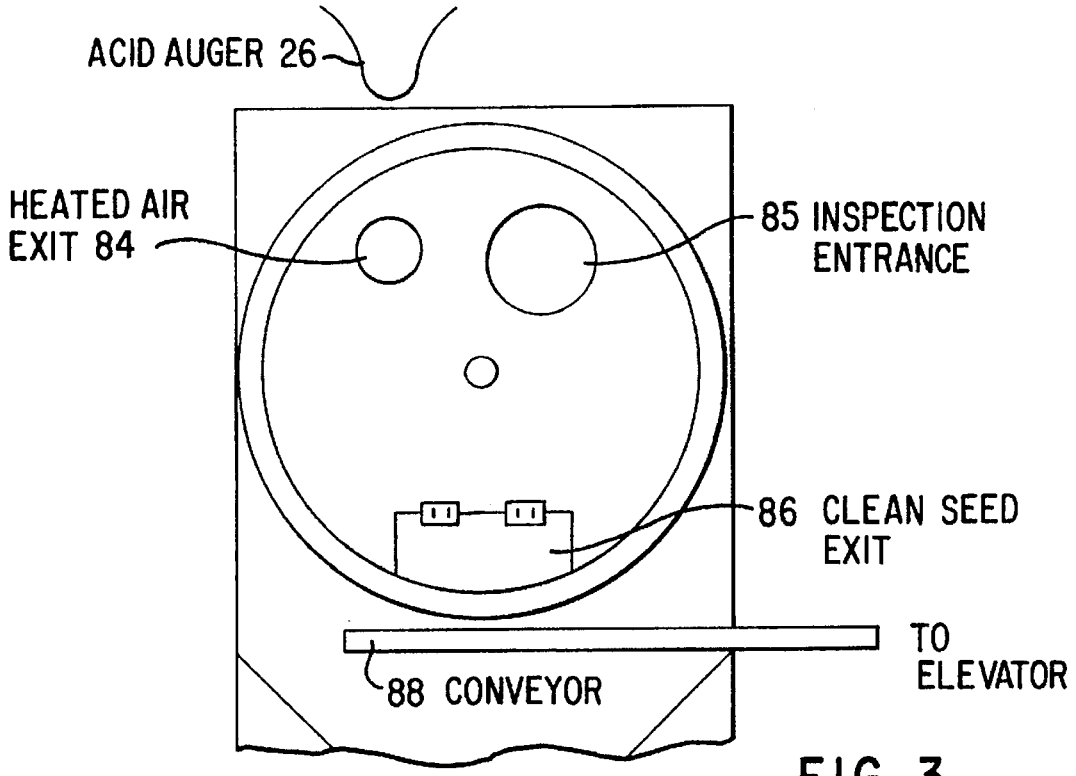
FIG. 3 is an end view of the exit end of the reaction chamber of FIG. 2 taken along the plane C—C.

FIG. 3 shows the exit end of the apparatus of FIG. 2 in cross section along the plane C—C of FIG. 2. In addition to the heated air exit 84 and the exit door 86, there is provided an inspection entrance 85 for allowing visual inspection of the interior of the reaction chamber 34.

In the operation of the embodiment of FIGS. 1–5, fuzzy seed to be delinted is first gently saturated with dilute acid solution in the acid applicator 26 and is then introduced as described above into the reaction chamber 34 for drying and hydrolyzation. The flight path of the saturated seed as it is tumbled within the rotating drum 70 of the reaction chamber 34 is selected such that the tumbling action within the rotating drum 70 is extremely gentle. The close flight placement within the rotating drum 70 minimizes seed agitation and assures that the seed cushion each other while being tumbled and that the seed do not to any significant degree impact the metal structure of the drum 70.

Figure 6:
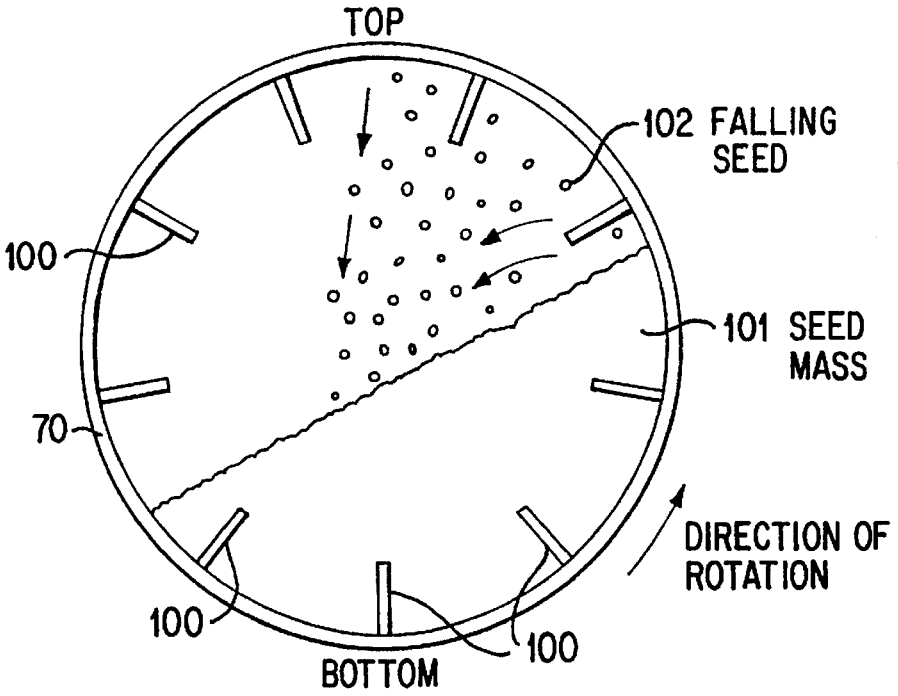
FIG. 6 is a cross sectional view of the reaction chamber cylindrical drum showing the placement of internal vanes within the drum for directing the flight pattern of the seed within the drum.

FIG. 6 shows a preferred internal configuration of the drum 70 in which guide vanes 100 extending radially inwardly from the outer periphery of the drum to guide the flight path of the seed within the drum 70. In the embodiment illustrated in FIG. 1, in which the radius of the drum is about three feet, the vanes 100 extend radially inwardly about nine inches and there are nine guide vanes 100 which are spaced apart from each other by about 24.5 inch chords. That is, for the particular embodiment illustrated in FIG. 1, where the radius of the drum is about three feet, the guide vanes 100 extend radially inward by an amount preferably less than about one-third of the radius, in this case by about nine inches. The number of guide vanes is nine in the preferred embodiment but can be selected in relation to the radial dimension and other conditions. However, the total number of guide vanes should be less than about twelve to fifteen and preferably about nine as illustrated in FIG. 6.

As shown in FIG. 6 and for the direction of rotation as indicated by the arrow, the seed mass 101 remains essentially intact as it is lifted from the bottom position and toward the upper portion of the rotation and then begins to disperse into discrete seeds and clumps of seeds shown as falling seed 102 in FIG. 6. The dimensions and placement of the guide vanes 100 and the precise rotational control of the rotation of the drum are selected so that there is little movement of the seed as it is being lifted from the bottom position to the top of the drum where it is dropped back through the heated air stream. Seed being dropped back from the top position therefore impact back upon themselves to cushion their fall so that direct impact with the metal walls of the drum, which could cause physical impact damage to the seed, is avoided. That is, the falling seed descending from the top of the drum fall back on the seed mass 101 and are thus cushioned against impact with the internal surfaces of the drum 70.

The use of the internal vanes thus avoids random tumbling of the seed within the rotating drum and precisely controls the flight pattern of the drying seed to avoid damage to the seed while the seed is being dried and the lint hydrolyzed.

The apparatus and method of the present invention thus meet the criteria first set forth above and provide a batch type method and apparatus which can economically delint and recover small quantities of valuable seed, such as breeder seed, without damaging the same and which are suitable for replanting purposes. It is to be understood that the embodiments presented herein are for the purpose of providing a full and clear disclosure of the present invention. Various changes and substitutions will occur to those skilled in the art, it being understood that the embodiments presented do not limit in any way the scope of the present invention as defined in the appended claims.

I claim:

1. A batch apparatus for removing lint from fuzzy cotton seed which is to be used for planting purposes comprising:

seed delivery means for delivering a batch quantity of fuzzy cotton seed to be delinted;

pumping means for forming a first feed stream of a dilute acid solution;

seed feeder means for forming a second feed stream of fuzzy cotton seed from the batch quantity of fuzzy cotton seed delivered by said seed delivery means and from which lint is to be removed;

dilute acid applicator means forming an elongated flow path extending from an inlet end thereof to an exit end thereof for gradually applying dilute acid solution to said fuzzy cotton seed;

said dilute acid applicator means including merging means at the inlet end thereof for merging the flows of said first and second feed streams at said inlet end of said elongated flow path for forming a composite stream at said inlet end containing said dilute acid first feed stream and said fuzzy cotton seed second feed stream;

said dilute acid applicator means also including mixing means extending along said elongated flow path for gently mixing said composite stream from said inlet end along said elongated flow path to gradually blend said first and second feed streams with each other and thereby gradually saturate the lint on said fuzzy cotton seed with said dilute acid solution along the length of said elongated flow path from said inlet end thereof to an exit end thereof;

said dilute acid applicator means further including discharge means for discharging the mixed composite stream of dilute acid solution-saturated fuzzy cotton seed at said exit end of said elongated flow path;

a reaction chamber having a rotatable drum mounted therein and being connected to receive dilute acid solution-saturated fuzzy cotton seed from said discharge means into said rotatable drum;

means for rotating said rotatable drum and means for circulating heated air through said rotatable drum from an inlet opening through a discharge opening while continuously rotating said rotatable drum;

air temperature control means for controlling the temperature of said heated air to evaporate the water in said dilute acid solution and thereby cause hydrolization of the lint on said fuzzy cotton seed to produce delinted seed, said air temperature control means also for limiting the temperature of the heated air at said discharge opening at a level below that at which heat damage to the suitability of the delinted seed for planting could occur;

means for entraining the hydrolized lint in the circulating heated air to remove the hydrolyzed lint from said reaction chamber; and means for separately removing a batch quantity of delinted seed from said reaction chamber after said batch quantity has been delinted.

2. A batch apparatus for removing lint from fuzzy cotton seed as set forth in claim 1 in which said rotatable drum further comprises means for directing the flight path of seed within said rotatable drum to cause the seed to fall back on itself as it is dropped from the top of the rotatable drum during the rotation of the rotatable drum.

3. A batch apparatus for removing lint from fuzzy cotton seed as set forth in claim 2 in which said means for directing the flight path of seed within said rotatable drum comprises a plurality of guide vanes extending radially inward from the periphery of said rotatable drum for guiding the flight path of the seed within the rotatable drum during the delinting process to cause the seed to fall back onto itself during the rotation of said rotatable drum and thereby cushion the fall of the seed and minimize impact of the seed with the walls of said rotatable drum.

4. A batch apparatus for removing lint from fuzzy cotton seed as set forth in claim 3 in which the number of said guide vanes is fifteen or less.

5. A batch apparatus for removing lint from fuzzy cotton seed as set forth in claim 3 in which said guide vanes extend radially inward by less than one-third the radius of said rotatable drum.

6. A batch apparatus for removing lint from fuzzy cotton seed as set forth in claim 1 in which the axis of rotation of said rotatable drum is inclined with respect to the horizontal to facilitate movement of the seed from one end of the rotatable drum to the other.

7. A batch apparatus for removing lint from fuzzy cotton seed as set forth in claim 6 in which said axis of rotation of said rotatable drum is inclined by 10° or less with respect to the horizontal.

8. A batch apparatus for removing lint from fuzzy cotton seed as set forth in claim 1 in which said air temperature control means includes means for limiting the temperature of the heated air at said discharge opening to about 140° F. or less.

9. A batch apparatus for removing lint from fuzzy cotton seed as set forth in claim 1 in which said means for rotating said rotatable drum includes means for regulating the rotational speed of said rotatable drum at a substantially constant speed within the range of less than about thirty revolutions per minute.

10. A batch apparatus for removing lint from fuzzy cotton seed as set forth in claim 1 in which said means for rotating said rotatable drum includes means for regulating the rotational speed of said rotatable drum at a substantially constant speed within the range of about eighteen to about twenty two revolutions per minute.

* * * * *

UNITED STATES PATENT AND TRADEMARK OFFICE

CERTIFICATE OF CORRECTION

PATENT NO. : 5,638,634

DATED : June 17, 1997

INVENTOR(S) : James B. Wadlington

It is certified that error appears in the above-indentified patent and that said Letters Patent is hereby corrected as shown below:

In the Claims: Col. 10, line 2, "the" should be deleted.

Signed and Sealed this

Twenty-fourth Day of March, 1998

*Attest:*

*Attesting Officer*

BRUCE LEHMAN

*Commissioner of Patents and Trademarks*